United States Patent [19]

Dawson et al.

[11] Patent Number: 4,575,875

[45] Date of Patent: Mar. 18, 1986

[54] DETACHABLE VISOR FOR A MOTORCYCLE HELMET

[75] Inventors: Chris R. Dawson, San Diego, Calif.; John Dondero, Sun Valley, Id.; Gerald R. Parks, Chula Vista, Calif.

[73] Assignee: John R. Gregory, Chula Vista, Calif.

[21] Appl. No.: 621,707

[22] Filed: Jun. 18, 1984

[51] Int. Cl.[4] ..... A42B 3/02; A61F 9/04

[52] U.S. Cl. ..... 2/422; 2/424; 2/10; 2/12

[58] Field of Search ..... 2/422, 424, 5, 10, 6, 2/12, 185 R, 199

[56] References Cited

U.S. PATENT DOCUMENTS

| | | | |
|---|---|---|---|
| 2,330,442 | 9/1943 | Nero | 2/12 |
| 3,765,031 | 10/1973 | Beresic | 2/422 |
| 4,117,553 | 10/1978 | Bay | 2/10 |
| 4,333,180 | 6/1982 | Bay | 2/10 |

FOREIGN PATENT DOCUMENTS

| | | | |
|---|---|---|---|
| 2296440 | 7/1976 | France | 2/10 |
| 2398470 | 2/1979 | France | 2/10 |

*Primary Examiner*—Peter Nerbun

*Attorney, Agent, or Firm*—Charmasson & Holz

[57] ABSTRACT

A detachable visor for a motorcycle helmet having a top wall with laterally spaced side wall members that extend downwardly from the lateral edges of the top wall. A laterally extending recess portion is formed in the top wall intermediate its front edge and its rear edge. The recess portion has a downwardly extending rear wall and a pair of laterally spaced downwardly extending side walls. A plurality of snap fasteners have their female portions attached to the rear surface of the rear wall and they are laterally spaced apart from each other so that they mate with the male portion of the snap fasteners that are secured to the outer surface of the forehead portion of a motorcycle helmet. A top wall cover panel is detachably secured to the side walls in the recess portion to form an aerodynamically smooth top wall surface on the detachable visor. An air flow deflector panel extends between the side wall members of the visor and functions to direct air into the interior of the helmet. A female fastener portion is integrally formed on the inner surface of each the side wall members and these mate with a male portion of a detachable fastener which is secured to the side of the motorcycle helmet.

5 Claims, 3 Drawing Figures

DETACHABLE VISOR FOR A MOTORCYCLE HELMET

BACKGROUND OF THE INVENTION

The present invention relates to a visor and more particularly to a detachable visor for a motorcycle helmet.

In the past most of these detachable motorcycle helmet visors have had a top wall whose rear edge has an upright wall extending up there from. This upright wall has a plurality of female portions of snap fasteners attached thereto at predetermined laterally spaced intervals. The angle at which the top wall of the visor meets its upright wall portion is somewhere between 90 degrees and 150 degrees. The result has been that air passing over the top of the visor will hit the forehead portion of the helmet at an abrupt angle which is aerodynamically not very efficient. Additionally, prior art motorcycle visors have had recess portions formed in their top surface that acted to catch air traveling over the top surface of the visor thereby producing increased wind resistance. Previous detachable visors for motorcycles also had a concave surface on their bottom which captured air thereunder between the underside of the visor and the forehead portion of the helmet.

It is an object of the invention to provide a novel detachable visor for a motorcycle helmet that minimizes wind resistance across its top surface and especially where it is attached to the motorcycle helmet.

It is also an object of the invention to provide a novel detachable visor for a motorcycle helmet that has an aerodynamically smooth top surface free of recess portions.

It is also an object of the invention to provide a novel detachable visor for a motorcycle helmet that has structure that eliminates external snap fastner portions on the side walls of the visor.

It is another object of the invention to provide a novel detachable visor for a motorcycle helmet that has structure for directing air flow passing beneath the visor to air ventilation channels in the interior of the helmet.

It is a further object of the invention to provide a novel detachable visor for a motorcycle helmet that is easily attached and detached therefrom.

It is an additional object of the invention to provide a novel detachable visor for a motorcycle helmet that is economical to manufacture and assemble.

SUMMARY OF THE INVENTION

Applicant's novel detachable visor for a motorcycle helmet has been designed to function in its most aerodynamic manner by reducing wind resistance. The angle at which the rear edge of the visor intersects the forehead portion of the helmet has been eliminated thereby reducing the wind resistance against the forehead portion of the motorcycle helmet. Additionally, the recess portion in the top surface of the visor has been provided with a detachable cover panel to produce a substantially smooth drag free top surface on the visor. The elimination of portions of any fasteners from the external surface of the side wall members of the visor have further reduced the wind resistance encountered by the helmet.

The air flow deflector panel that is provided on the bottom surface of the detachable visor functions to direct air flow under the visor in an orderly fashion to the ventilation channel within the top portion of the interior of the motorcycle helmet. This air flow deflector also eliminates the trapping of air beneath the visor between itself and the forehead portion of the helmet. The air flow deflector panel is also given an opaque or non-reflective surface so that it also functions as an anti-glare panel for its wearer.

DESCRIPTION OF THE PREFERRED EMBODIMENT

Figure 1:
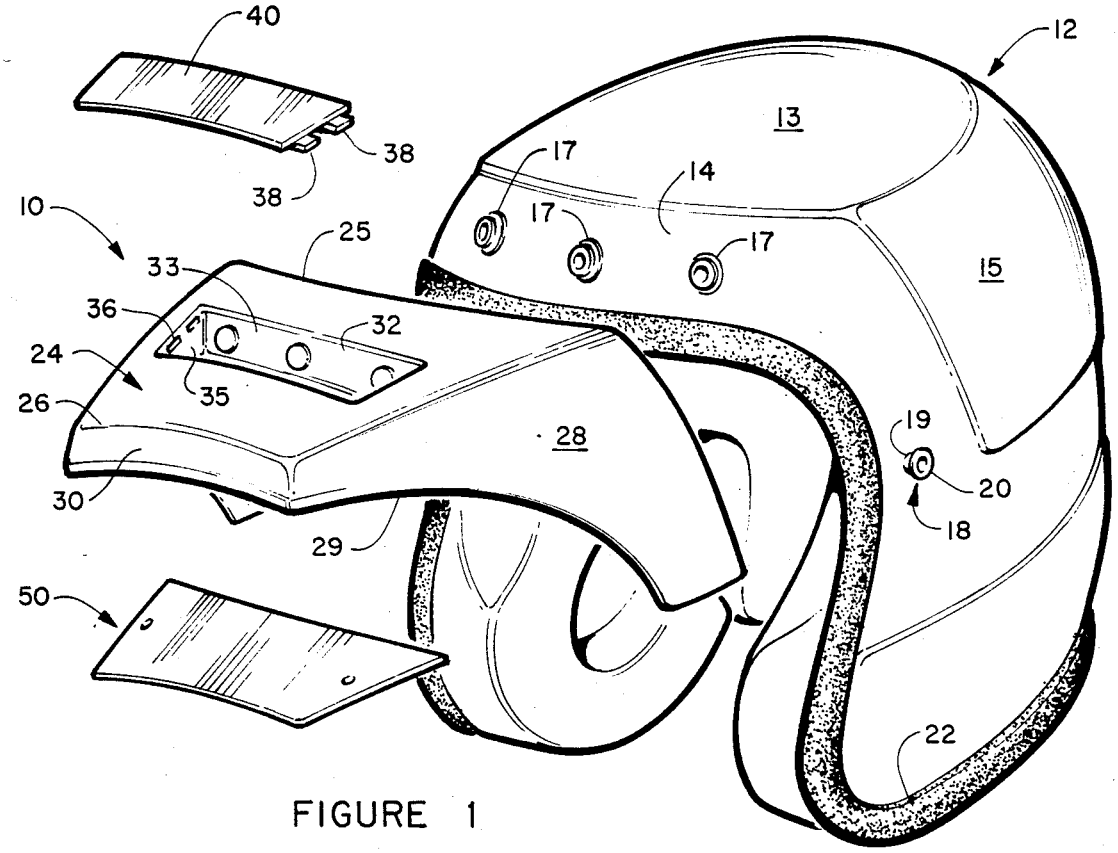
FIG. 1 is an exploded perspective view illustrating the novel detachable visor and a motorcycle helmet.
Figure 2:
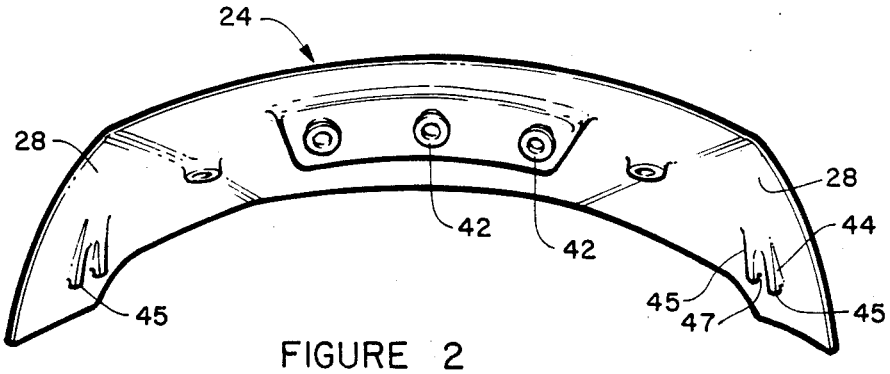
FIG. 2 is a rear elevation view of the novel detachable visor.
Figure 3:
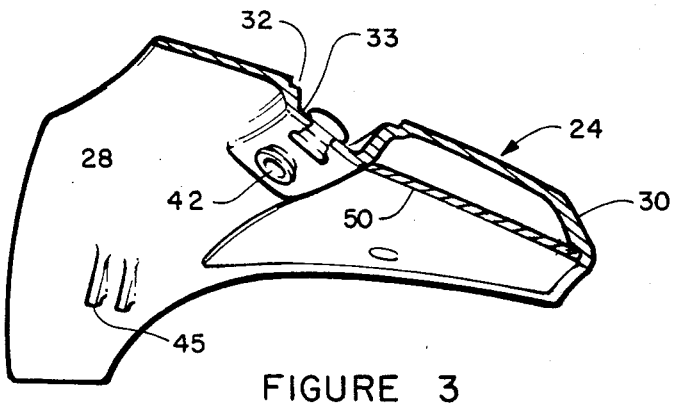
FIG. 3 is a cross-sectional elevation view through the central area of the detachable visor.

Applicant's novel detachable visor for a motorcycle helmet is generally designated numeral 10. Its structure will be described by referring to FIGS. 1–3 of the drawings.

Detachable visor 10 has been designed to attach to motorcycle helmet 12. Helmet 12 has a top portion 13, a forehead portion 14, and side portions 15. A plurality of male portions 17 of a snap fastener are attached to the forehead portion 14 of the helmet. On the sides 15 of the helmet, male fasteners 18 have been attached and they have a shank portion 19 and a flange 20 formed at its outer end. A trim molding 22 extends around a major portion of the helmet.

Visor 10 has a top wall 24 having a rear edge 25 and a front edge 26. Side wall members 28 extend downwardly from the lateral edges of top wall 24 and they have a bottom edge 29 of their own. A front lip 30 is formed on top wall 24.

A recess portion 32 is formed intermediate rear edge 25 and front edge 26 of top wall 24. Recess portion 32 has a rear wall 33 and a pair of laterally spaced side walls 35. A tab slot 36 is formed adjacent the top edge of each of the side walls 35 and into these tab slots are inserted tabs 38 that extend laterally from the opposite ends of top wall cover panel 40. Top wall cover panel 40 is removeable to aid in the attachment of the visor 10 to the male portions 17 of the snap fasteners on the forehead portion 14 of the motorcycle helmet. The rear surface of rear wall 33 has a plurality of female portions 42 of snap fasteners attached thereto (See FIGS. 2 and 3).

The rear surface of side wall members 28 have integrally molded female fasteners 44 formed thereon. These fasteners have a pair of spaced fingers 45 and 46 that form a slot 47 therebetween them that mates with shank 19 and captures the flange 20 of the male fastener 18 under fingers 45 and 46.

An air flow deflector panel 50 is attached to the underside of visor 10 by suitable fastening structure.

We claim:

1. A detachable visor for a motorcycle helmet having snap fasteners on its frontal surface comprising:

a main body having a wedge-shaped side profile and including a top wall shaped and dimensioned to meet the frontal surface of the helmet above said snap fasteners;

laterally spaced side wall members that extend downwardly from the lateral edges of said top wall, said top wall having a front edge and a rear edge;

a laterally extending recess portion is formed in said top wall intermediate its front edge and its rear edge, said recess portion having a downwardly extending rear wall and a pair of laterally spaced downwardly extending side walls, said rear wall being shaped to conform with the frontal surface of the helmet mounting said fasteners and having a plurality of snap fasteners designed and positioned so that they mate with the snap fasteners that are secured to the frontal surface of the motorcycle helmet; and an air flow detector panel that extends between said side wall members and is attached to the underside of said visor, said air flow deflector panel extends rearwardly a predetermined distance from the front of said top wall.

2. A detachable visor as recited in claim 1 further comprising a top wall cover panel for said recess portion having peripheral tabs, and the walls of said recess portion having slots for engaging said tabs.

3. A detachable visor as recited in claim 1 wherein said top wall has a convex top surface curvature across its lateral width.

4. A detachable visor as recited in claim 1 further comprising means for detachably fastening said side wall members to a motorcycle helmet.

5. A detachable visor as recited in claim 4 wherein said means for detachably fastening said side wall members to a motorcycle helmet comprises a female fastener portion which is integrally formed on the inner surface of said side wall members, said female fastener portions each having a slot formed between a pair of lateral spaced fingers and this slot mates with the shank of the male portion of said detachable fastener which is secured to the side of said motorcycle helmet.

* * * * *